US008074479B2

(12) United States Patent
Harley

(10) Patent No.: US 8,074,479 B2
(45) Date of Patent: Dec. 13, 2011

(54) LOCK AND AN ELECTROMECHANICAL LOCKING SYSTEM

(75) Inventor: David Harley, Cape Town (ZA)

(73) Assignee: Yebo Tech (Proprietary) Limited, Cape Town (ZA)

( * ) Notice: Subject to any disclaimer, the term of this patent is extended or adjusted under 35 U.S.C. 154(b) by 551 days.

(21) Appl. No.: 12/086,554

(22) PCT Filed: Dec. 13, 2006

(86) PCT No.: PCT/IB2006/003600

§ 371 (c)(1),
(2), (4) Date: Dec. 23, 2008

(87) PCT Pub. No.: WO2007/069047

PCT Pub. Date: Jun. 21, 2007

(65) Prior Publication Data

US 2009/0308119 A1 Dec. 17, 2009

(30) Foreign Application Priority Data

Dec. 13, 2005 (ZA) ..... 2005/10146

(51) Int. Cl.
*E05B 47/00* (2006.01)

(52) U.S. Cl. ..... 70/277; 70/278.3; 70/283.1

(58) Field of Classification Search ..... 70/222–223, 70/277, 276, 278.1–278.3, 283, 283.1, 189, 70/472

See application file for complete search history.

(56) References Cited

U.S. PATENT DOCUMENTS

| | | | | |
|---|---|---|---|---|
| 3,748,878 | A * | 7/1973 | Balzano et al. | 70/218 |
| 5,791,177 | A | 8/1998 | Bianco | |
| 5,974,367 | A * | 10/1999 | Bianco | 340/5.21 |
| 6,668,606 | B1 * | 12/2003 | Russell et al. | 70/278.3 |
| 6,807,834 | B2 * | 10/2004 | Tsai | 70/472 |
| 6,854,305 | B2 * | 2/2005 | Hurskainen et al. | 70/278.3 |
| 7,000,441 | B2 * | 2/2006 | Sutton et al. | 70/276 |
| 2009/0308117 | A1 * | 12/2009 | Goldman | 70/277 |

FOREIGN PATENT DOCUMENTS

| | | |
|---|---|---|
| DE | 3602989 | 11/1987 |
| WO | WO02/16714 | 2/2002 |

OTHER PUBLICATIONS

PCT International Search Report and Written Opinion for International Patent Application No. PCT/IB2006/003600, dated Jun. 22, 2007.

* cited by examiner

*Primary Examiner* — Suzanne Barrett
(74) *Attorney, Agent, or Firm* — Winston & Strawn

(57) ABSTRACT

An electromechanical locking system (8) comprises a lock (12) and a key (14). The lock includes a cylinder (16), an electronic control unit (18) which is housed within the cylinder, a tailpiece (20), and an electrically-operable clutch mechanism (22) which is housed within the cylinder (16). The cylinder (16) is rotatably mounted to a first component to be locked and the tailpiece includes an adapter (24) which is operable to interfere with the movement of a second component to be locked to the first component. The control unit (18) draws power from the key and is operable to generate an actuation signal for actuating the clutch mechanism (22) which releasably connects the cylinder and the tailpiece when actuated, thereby causing them to become rotatably coupled.

14 Claims, 16 Drawing Sheets

Forces during actuation

LOCK AND AN ELECTROMECHANICAL LOCKING SYSTEM

This application is a national stage filing under 35 USC §371 of International application number PCT/IB2006/003600, filed Dec. 13, 2006, which claims priority to South African application number 2005/10146, filed Dec. 13, 2005.

FIELD OF INVENTION

This invention relates to a lock and to an electromechanical locking system.

BACKGROUND TO THE INVENTION

The wide deployment of electromechanical locking devices is in part hampered by the power requirements and size of the actuation mechanisms needed to effect unlocking of such electromechanical locking devices. In order to unlock an electromechanical locking device, the locking device requires an actuator which is operable to move a mechanism within the locking device in response to an electrical signal being received from the locking device's electronic control unit. This electrical signal typically causes the actuator to either release a blocking pin which enables a user to turn or slide a mechanism in order to extract a bolt or it may exert sufficient power to extract the bolt without mechanical assistance from a user's hand. In the latter case, the locking device would typically have to be supplied with external power from a mains power supply which restricts the field of application of such locking devices.

An electromechanical locking device which relies upon the strength of a human hand to extract the lock bolt consumes much less power and can be operated by battery-powered sources thereby widening the field of application of such devices. However, existing electromechanical locking devices typically include a locking mechanism in the form of a blocking device which prevents the mechanical component to which a user has access from moving unless an actuator has received an actuation signal from the control unit of the locking device to release the blocking mechanism. As the blocking mechanism is vulnerable to brute force attack in which sufficient strength may be applied to the lock causing the blocking mechanism to fail, such blocking mechanisms are designed to withstand large external forces and as a result are relatively large and heavy. Consequently, the strength requirements of such blocking mechanisms imposes a burden upon the actuators which are required to release such blocking mechanisms, thereby increasing the actuator size and power consumption. This limits the practicality of using battery powered sources for lock actuation. A further problem with such electromechanical locking devices is related to the time it takes to perform lock actuation. Typically, a user should be able to insert a key and open a lock without perceptible delay. To accomplish this, the actuator needs to be relatively fast in its operation. The actuator must also not stick in the event that the user begins to exert a force against the lock before the actuator has had time to release the lock. Such speed and absence of sticking are difficult to accomplish with a relatively heavy blocking device.

It is an object of the present invention to ameliorate the above-mentioned limitations of electromechanical locking devices.

SUMMARY OF INVENTION

According to the invention there is provided a lock comprising:

a) a cylinder defining an axis of rotation and having a front end and an opposite rear end, which can be rotatably mounted to a first component to be locked, the cylinder including at least one second locking formation; a keyway at the front end thereof, for a key having an electrical power source; and electrical connection means which provides an electrical connection with the electrical power source of the key;

b) a tailpiece which defines an axis of rotation common with the axis of rotation of the cylinder, the tailpiece including at least one first locking formation and being operable to interfere with the movement of a second component to be locked, the tailpiece being mounted to the cylinder at the rear end thereof in an arrangement wherein relative rotation between the tailpiece and the cylinder is permitted in an uncoupled condition of the lock and wherein the cylinder and the tailpiece are rotatably coupled in a coupled condition of the lock;

c) an electrically-operated clutch mechanism which includes at least one locking mechanism which is operable, upon actuation of the clutch mechanism, to releasably engage the first and second locking formations thereby causing the cylinder and the tailpiece to become rotatably coupled in said coupled condition of the lock; and d) electronic control means which is electrically connected to the electrical connection means and to the clutch mechanism and which is operable to generate an actuation signal for actuating the clutch mechanism;

the lock being characterized in that the locking mechanism of the clutch mechanism includes a magnet, an electrical coil displaceably located within the magnetic field of the magnet and a locking member having engagement formations for engaging said first and second locking formations, a blocking member to which the coil is fixedly connected, and first urging means for urging the blocking member into a blocking position relative to the locking member, the blocking member being operable in said blocking position, to cause disengagement of the locking member with the first and second locking formations in the uncoupled condition of the lock when the cylinder is rotated with respect to the tailpiece, the coil being electrically connected to the electronic control means in an arrangement wherein the coil is energized by power supplied by the power source of the key, in response to an actuation signal being received from the electronic control means, thereby to cause displacement of the blocking member out of said blocking position against the force exerted on it by the urging means, thereby allowing the locking member to engage the first and second locking formations in the coupled condition of the lock.

The locking mechanism may include second urging means for urging the locking member into engagement with the first and second locking formations.

The clutch mechanism may be housed within the cylinder.

The electronic control means may be housed within the cylinder.

The locking member and the blocking member may define common axes of rotation which are common to the axes of rotation of the cylinder and the tailpiece.

The first urging means may be in the form of a compression spring.

The locking member may be located rearwardly of the blocking member, the locking member being of relatively higher mass than that of the blocking member and the second urging means applying a sufficiently low urging force to the locking member so that if an external shock is applied to the lock in a longitudinal direction from the front end of the cylinder towards the tailpiece sufficient to cause the locking member to be displaced rearwardly into disengagement with the first and second locking formations, the blocking member will only be displaced from its blocking position at a relatively higher acceleration, thereby preventing coupling of the cylinder and the tailpiece.

The invention extends to an electromechanical locking system including a key having an electrical power source and a lock as defined hereinabove.

BRIEF DESCRIPTION OF THE DRAWINGS

Further features of the invention are described hereinafter by way of a non-limiting example of the invention, with reference to and as illustrated in the accompanying diagrammatic drawings. In the drawings.

DESCRIPTION OF PREFERRED EMBODIMENTS

Figure 1:
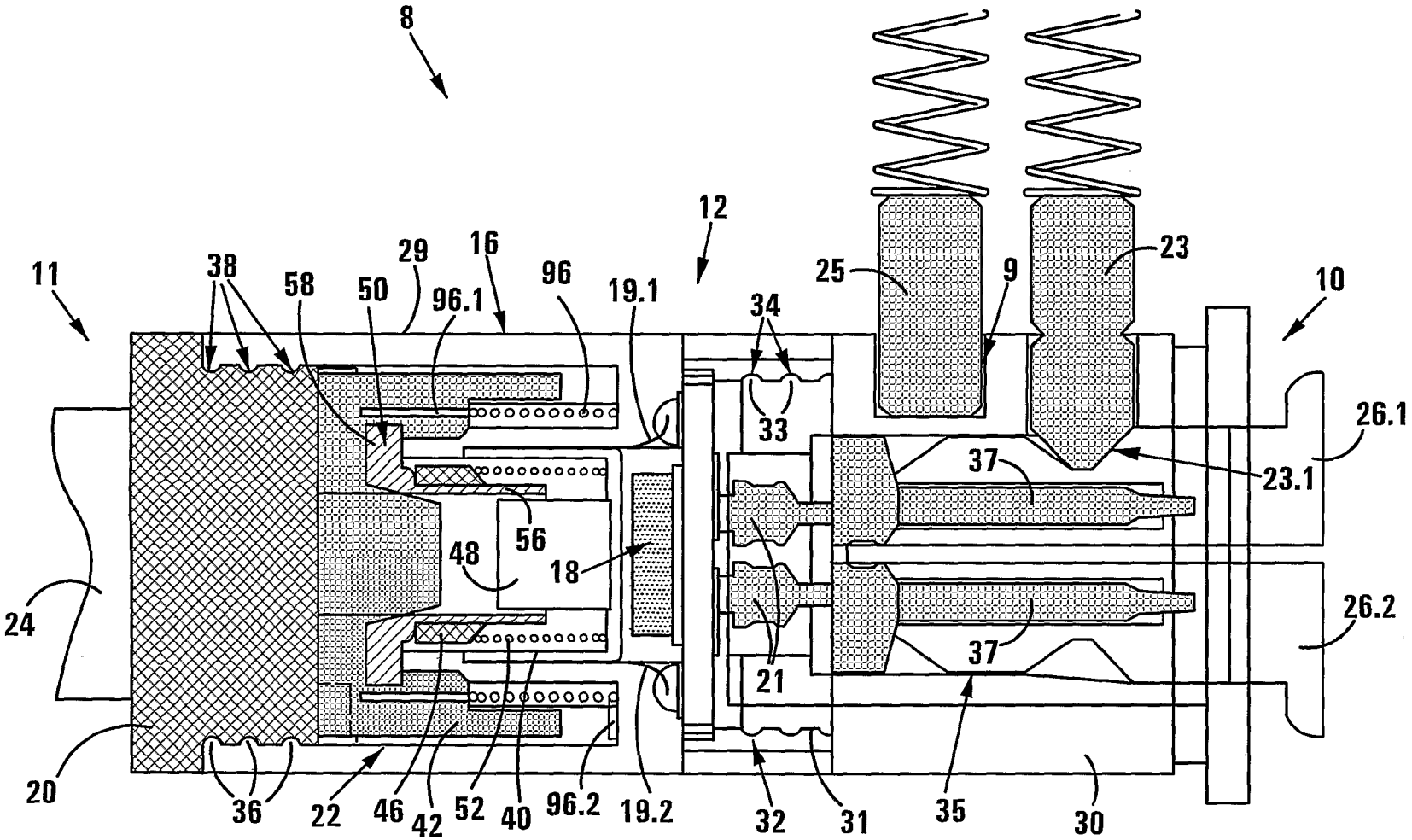
FIG. 1 shows a schematic sectional side view of a lock in accordance with the invention.

With reference to the drawings, a lock in accordance with the invention is designated generally by the reference numeral 12. The lock 12 is configured for use with a key 14. The lock 12 and the key 14 together forming an electromechanical locking system 8. The lock 12 has a front end 10 and a rear end 11 and includes a cylinder 16 which is rotatably mounted to a first component to be locked, an electronic control unit 18 which is housed within the cylinder, a tailpiece 20, a clutch mechanism 22 which is housed within the cylinder 16 and a tailpiece adapter 24. The tailpiece adapter 24 is connected to a lock bolt (not shown) or other conventional locking device which interferes with movement of a second component to be locked to the first component.

The key 14 comprises a metal split key blade 26 which is split into two key blade portions 26.1 and 26.2 and a key body 28. The key blade portions 26.1 and 26.2 provide for a 2-wire electrical contact with the lock 12. The key blade thus provides a means by which electrical power, data and mechanical effort is transmitted to the lock 12. The key blade portion 26.1 is notched on one or both sides thereof with pyramidal notches in a manner similar to a conventional key. The key body contains a SIM smart card in which an authorisation code can be stored and a printed circuit board which supports the key's electronics. The electronics of the key consists of a power regulator, a micro-controller supporting the lock protocol and power management functions. The key body further includes a battery supplying power to the key and lock electronics. A button 27 is provided which permits a user to selectively input data to the lock 12.

The lock 12 is sized so as to provide a drop-in replacement for conventional mechanical cylinder locks. It will be appreciated that the electromechanical locking system may be used in any application wherein a lock may be required. The cylinder 16 and the tailpiece 20 are of plastics material and are coupled to one another in an arrangement wherein the cylinder and tailpiece are rotatable relative to one another in a disengaged condition of the lock 12. In an engaged condition of the lock, the cylinder 16 and the tailpiece 20 are releasably connected to one another by the clutch mechanism, thereby causing the tailpiece and the cylinder to be rotatably coupled.

The cylinder 16 comprises a cylinder casing 29 and a key housing 30 which is fixedly connected to the cylinder casing 29 by means of a cylindrical spigot formation 31 which fits into a socket 32 defined by the cylinder casing. The spigot formation 31 defines a pair of annular ridges 33 and the socket defines a pair of complementary annular grooves 34 in which the ridges are received, providing a snap joint. The key housing defines a keyway 35 in which the key blade 26 is received. The key housing 30 includes two electrical contacts 37 which each comprise a pair of wiping contacts which make electrical contact on opposite sides of each of the two key blade portions. The wiping contacts for each key blade portion ensure that an adequate electrical connection is maintained between the lock and the key from the point of entry of the key blade 26 into the keyway 35, providing at least 150 μs during which the authorisation process may take place before the key is fully inserted and the user starts to turn the key. The contacts 37 are connected to the control unit 18 via electrical connectors 21.

The key housing 30 further includes a key blade locking pin 23 of a conventional design which interacts with the groove 23.1 in the key blade portion 26.1, preventing the key blade from being withdrawn from the key housing 30 when the cylinder 16 is rotated. A second cylinder locking pin 25 interacts with an annular groove 9 within the key housing 30 preventing the cylinder 16 from being displaced axially and thereby removed from the lock.

The cylinder 16 is rotatably connected to the tailpiece 20 by means of an annular snap joint wherein the cylinder casing 29 defines three annular ridges 36 and the tailpiece 20 defines three complementary annular grooves 38 which receive the ridges 36 in an arrangement permitting rotation of the cylinder relative to the tailpiece. As such, the cylinder and the tailpiece define common axes of rotation.

The control unit 18 includes electronic control means in the form of an electronic key interface which provides an electrical connection with the key blade 26 of the key 14 and for data transmission between the key 14 and the lock 12. When electrical contact is made between the key and the key interface, the key supplies a pulse of electrical power to the lock 12. The control unit 18 includes a power capacitor which releases sufficient electrical power to the lock enabling it to operate for a short period of time and to communicate with the key via the two-wire bus between power pulses using a Manchester bit-encoding scheme. The control unit 18 includes a microcontroller which is connected to the clutch mechanism 22 and the key interface and which is operable to send an actuation signal to the clutch mechanism for actuating the clutch mechanism.

The clutch mechanism 22 comprises a 0.3 mm thick silicone steel cup 40, a locking member in the form of a coupler 42, a coil 46 and a cylindrical Neodymium magnet 48 which contacts the steel cup 40 at a rear end of the magnet and which is partially located within the coil 46 at the front end of the magnet. The clutch mechanism 22 further includes a blocking member in the form of a bobbin 50 which is displaceable over the magnet 48 and which is acted upon by urging means in the form of a 5 mN bobbin return spring 52. The spring is a compression coil spring. Electrical wires (not shown) extend from the coil 46 via holes 54 in the steel cup 40 to the control unit 18 for energising the coil.

Figure 9:
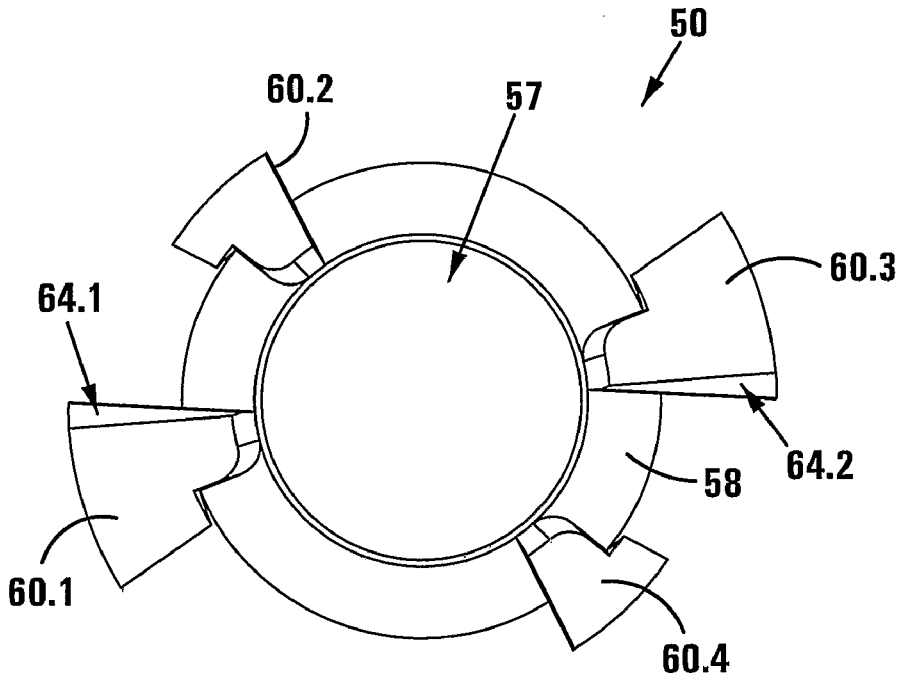
FIG. 9 shows a schematic rear end plan view of the bobbin of the lock of FIG. 1.
Figure 10:
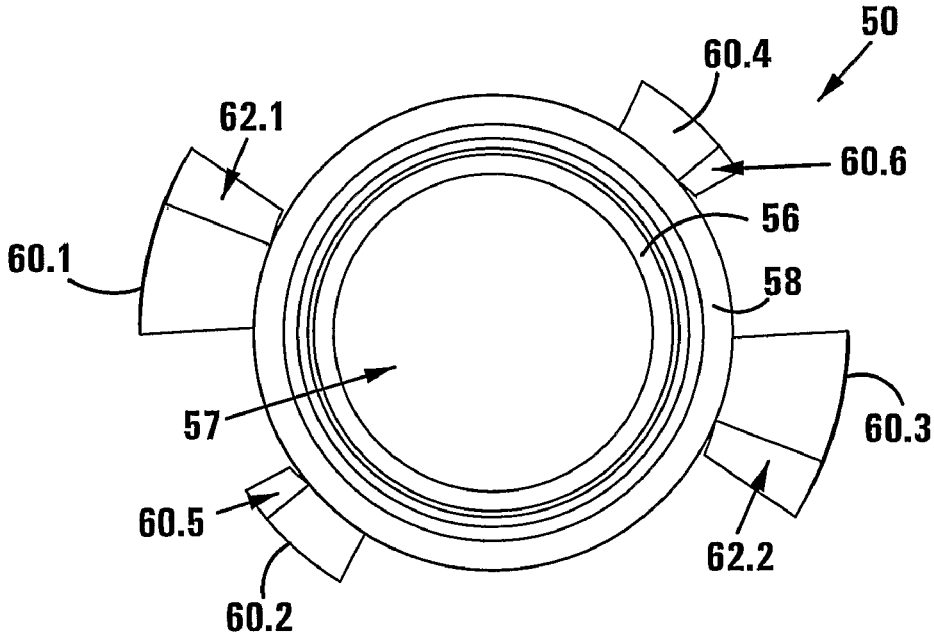
FIG. 10 shows a schematic front end plan view of the bobbin of FIG. 9.
Figure 11:
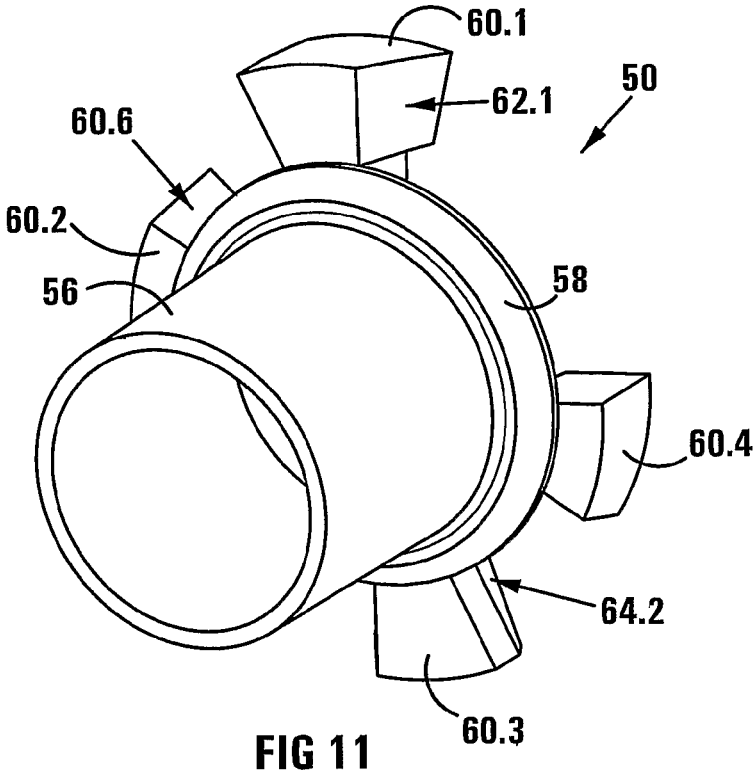
FIG. 11 shows a schematic perspective view of the bobbin of FIG. 9.

With reference to FIGS. 9-11, the bobbin 50 comprises a cylindrical wall 56 defining a central aperture 57, a flange 58 which is disposed at the rear end of the wall 56, a pair of blocking cogs 60.1 and 60.3 and a pair of guide cogs 60.2 and 60.4 which project radially outwardly from the flange 58. The blocking cogs 60.1 and 60.3 are disposed diametrically opposite one another, and the guide cogs 60.2 and 60.4 are similarly disposed diametrically opposite one another. The cogs 60.1 and 60.3 each define slanted engagement faces 62.1 and 62.2, respectively, the purpose of which will be explained hereinafter. The cogs 60.1 and 60.3 further define slanted release faces 64.1 and 64.2, respectively, which are disposed opposite the engagement faces the purpose of which will be explained hereinafter. The cogs 60.2 and 60.4 further define slanted retreat faces 60.5 and 60.6, respectively, the purpose of which will also be explained hereinafter.

Figure 12:
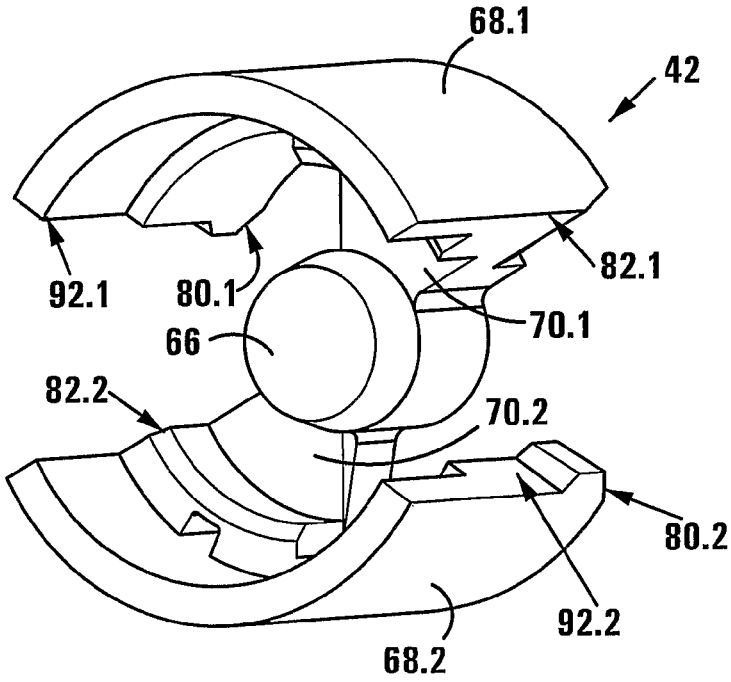
FIG. 12 shows a schematic perspective view of the coupler of the lock of FIG. 1.
Figure 13:
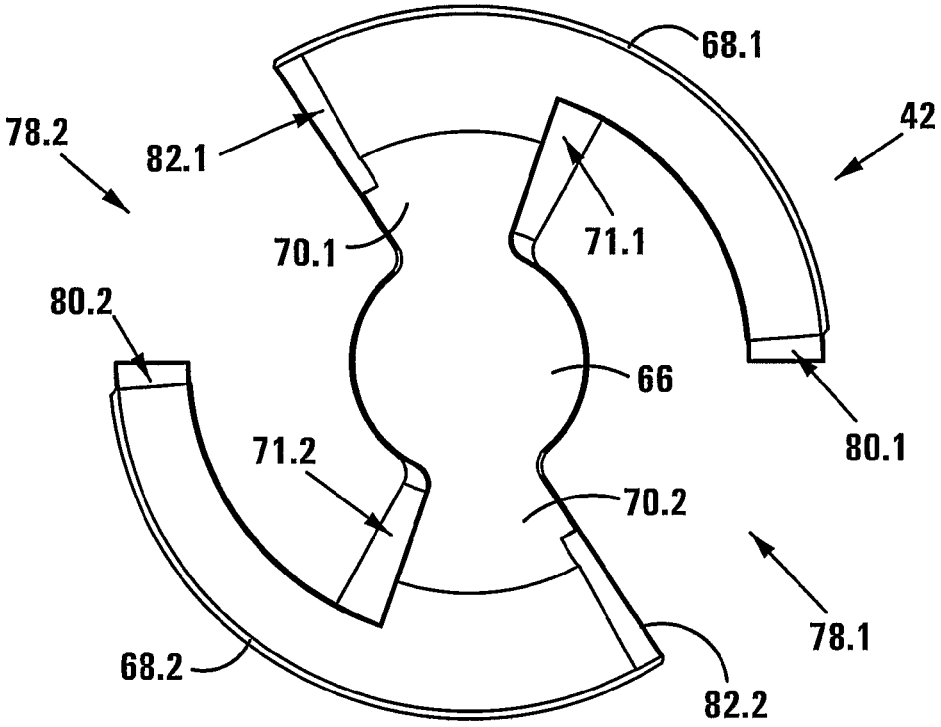
FIG. 13 shows a schematic rear end plan view of the coupler of FIG. 12.
Figure 14:
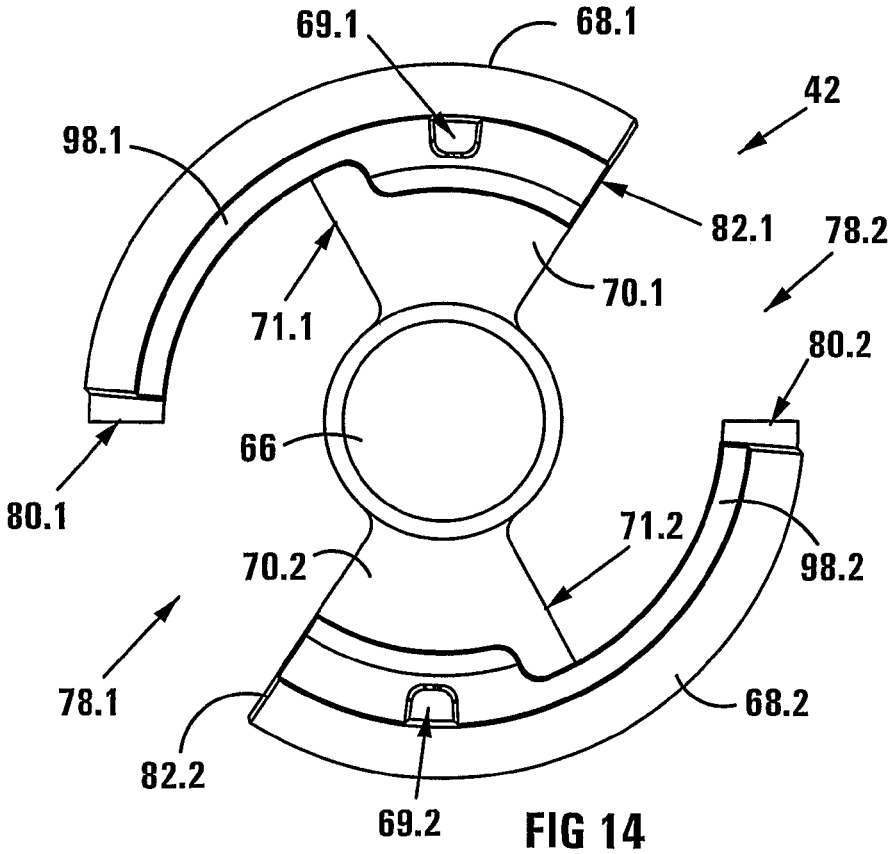
FIG. 14 shows a schematic front end plan view of the coupler of FIG. 12.

With reference to FIGS. 12-14, the coupler 42 comprises a central boss 66, a pair of curved wall sections 68.1 and 68.2 which are disposed opposite one another and which are joined to the boss 66 by means of webs 70.1 and 70.2. The curved wall sections 68.1 and 68.2 define circumferential spaces 78.1 and 78.2 between them. Distal ends of the wall sections 68.1 and 68.2 define slanted release faces 80.1 and 80.2, respectively, at operative rear ends thereof. Proximal ends of the wall sections 68.1 and 68.2 define engagement faces 82.1 and 82.2, respectively, at operative rear ends thereof. A major part of each distal end of the wall sections 68.1 and 68.2 define abutment faces 92.1 and 92.2. The webs 70.1 and 70.2 define slanted abutment faces 71.1 and 71.2, respectively. Elongate well formations 69.1 and 69.2 penetrate into the webs 70.1 and 70.2 from the front end of the coupler. The well formations are of sufficient size to accommodate the axial torsion spring peg 96.1

Figure 15:
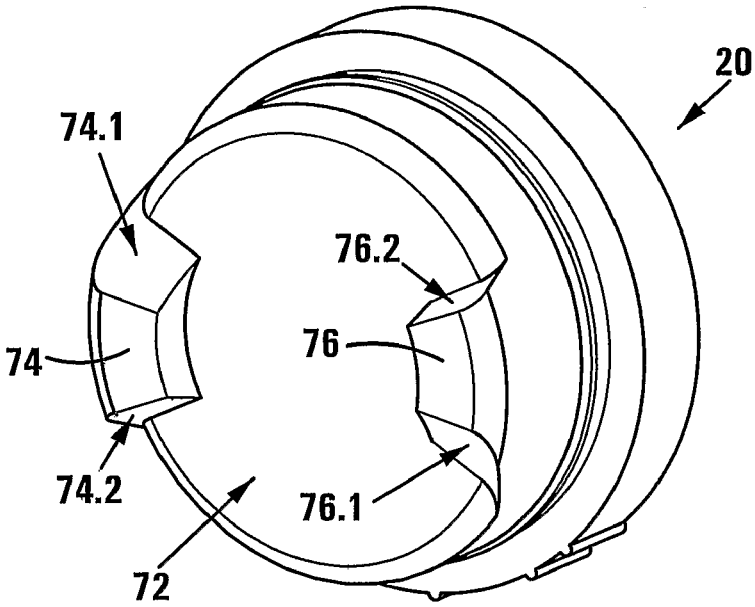
FIG. 15 shows a schematic perspective view from the front end, of the tailpiece of the lock of FIG. 1.

With reference to FIG. 15, the tailpiece 20 has a generally cylindrical configuration defining a front face 72 having a first engagement formation in the form of a first protuberance 74 and second engagement formation in the form of a second protuberance 76. The protuberance 74 has a slanted release face 74.1 at one end and an engagement face 74.2 at an opposite end thereof. The second protuberance 76 defines a slanted release face 76.1 at one and an engagement face 76.2 at an opposite end thereof.

Figure 16:
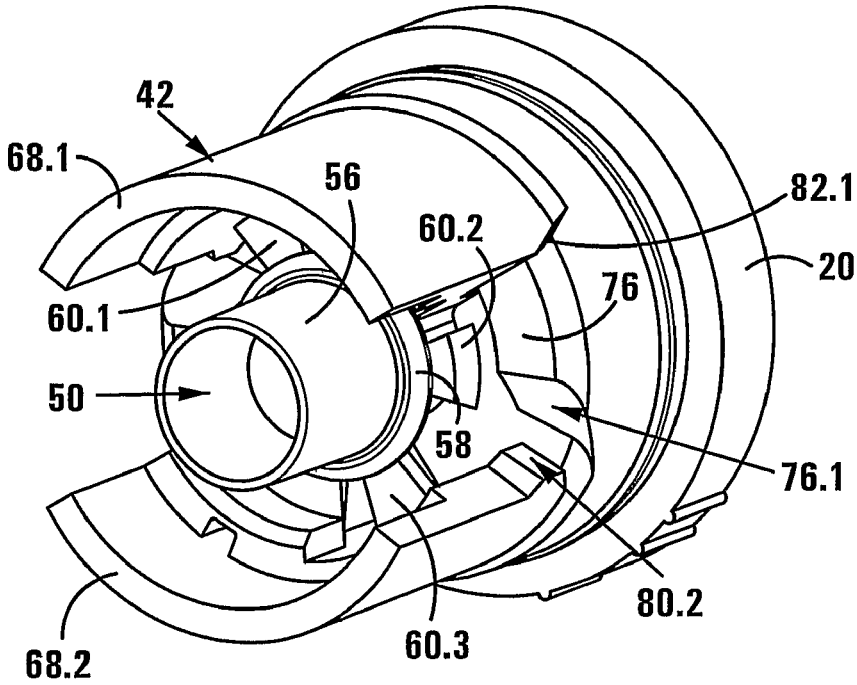
FIG. 16 shows a schematic perspective view from the front end, of the bobbin, coupler and tailpiece of the lock of FIG. 1 in an assembled condition.
Figure 17:
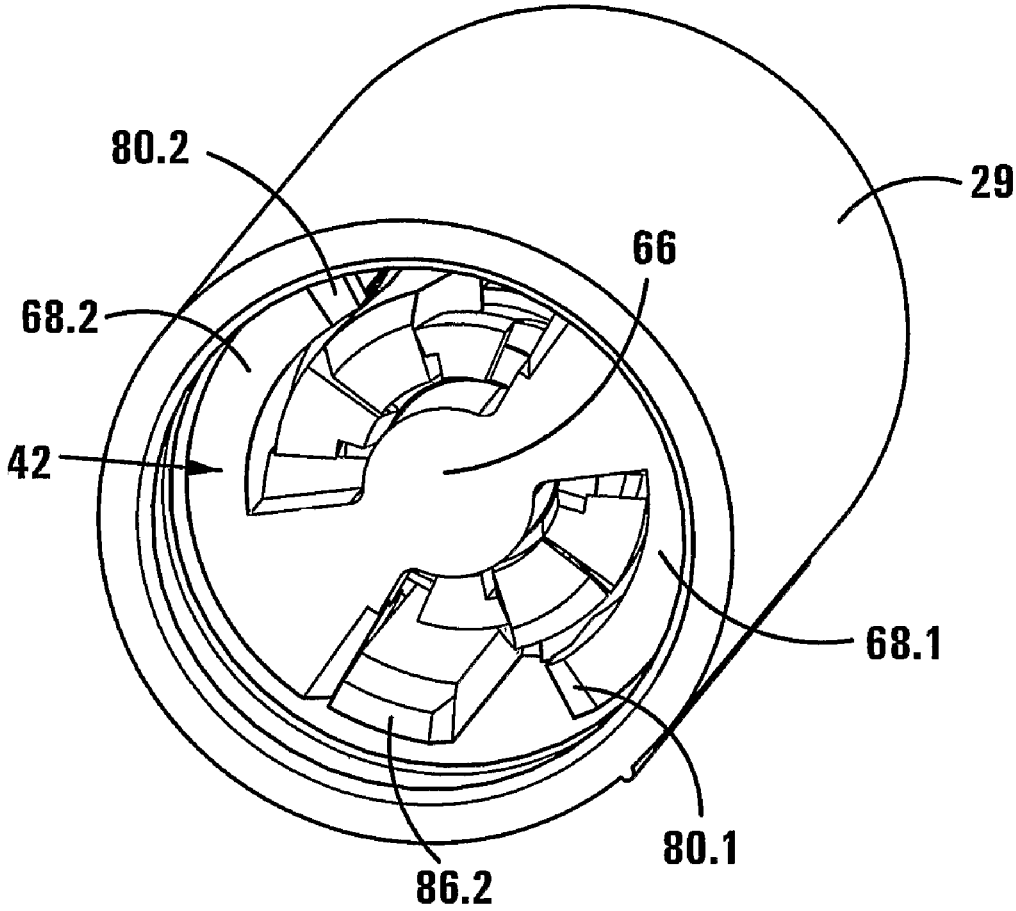
FIG. 17 shows a schematic perspective view from the rear end of the bobbin, coupler and tailpiece of the lock of FIG. 1 in an assembled condition.

In the assembled condition of the clutch mechanism 22, the rear end of the coupler 42 abuts the front end of the tailpiece 20, with the bobbin, having the coil 46 wound thereon, being located within the coupler, the assembled clutch mechanism being received within the cylinder casing 29. With reference to FIGS. 16 and 17, in the inactivated condition of the clutch mechanism 22, the protuberances 74 and 76 are located within the spaces 78.1 and 78.2, respectively, defined by the coupler 42. As such, when the coupler 42 is caused to rotate in a clockwise direction relative to the tailpiece 20 (when viewed from the front end of the lock), the engagement faces 82.1 and 82.2 engage the engagement faces 76.2 and 74.2, respectively, causing the coupler and the tailpiece 20 to become rotatably coupled. In this manner, torque can be applied via the coupler 42 to the tailpiece 20. Rotation of the coupler 42 in a counter-clockwise direction (when viewed from the front end of the lock) relative to the tailpiece, causes the slanted release faces 80.1 and 80.2 of the coupler 42 to slide over the slanted release faces 74.1 and 76.1, respectively, of the tailpiece 20, thereby causing the coupler to lift off the tailpiece and thereby become disengaged therefrom.

Figure 18:
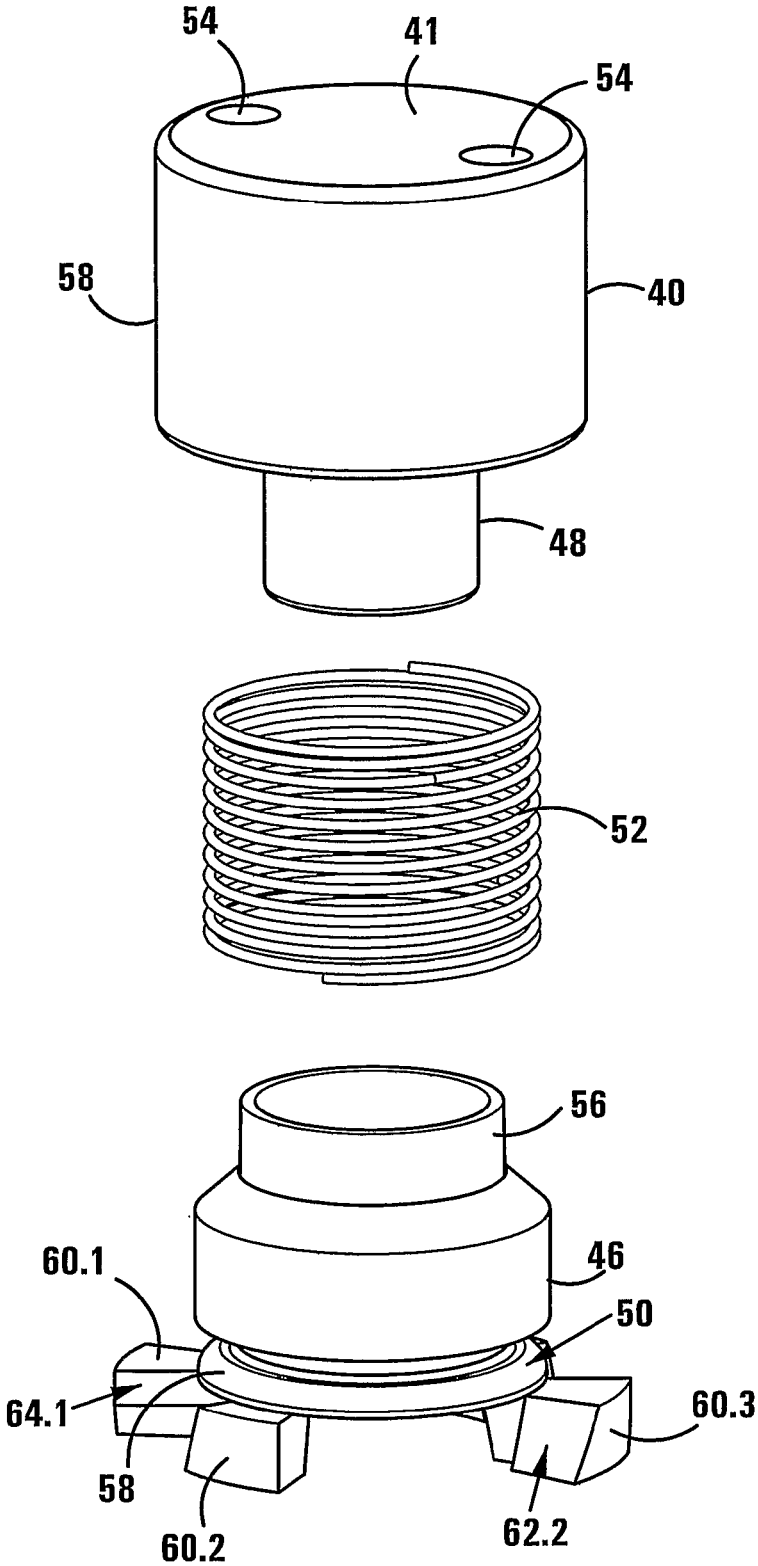
FIG. 18 shows a schematic exploded view of the bobbin, coil, spring, magnet and metal cup comprising the actuator assembly of the clutch mechanism of the lock of FIG. 1.
Figure 19:
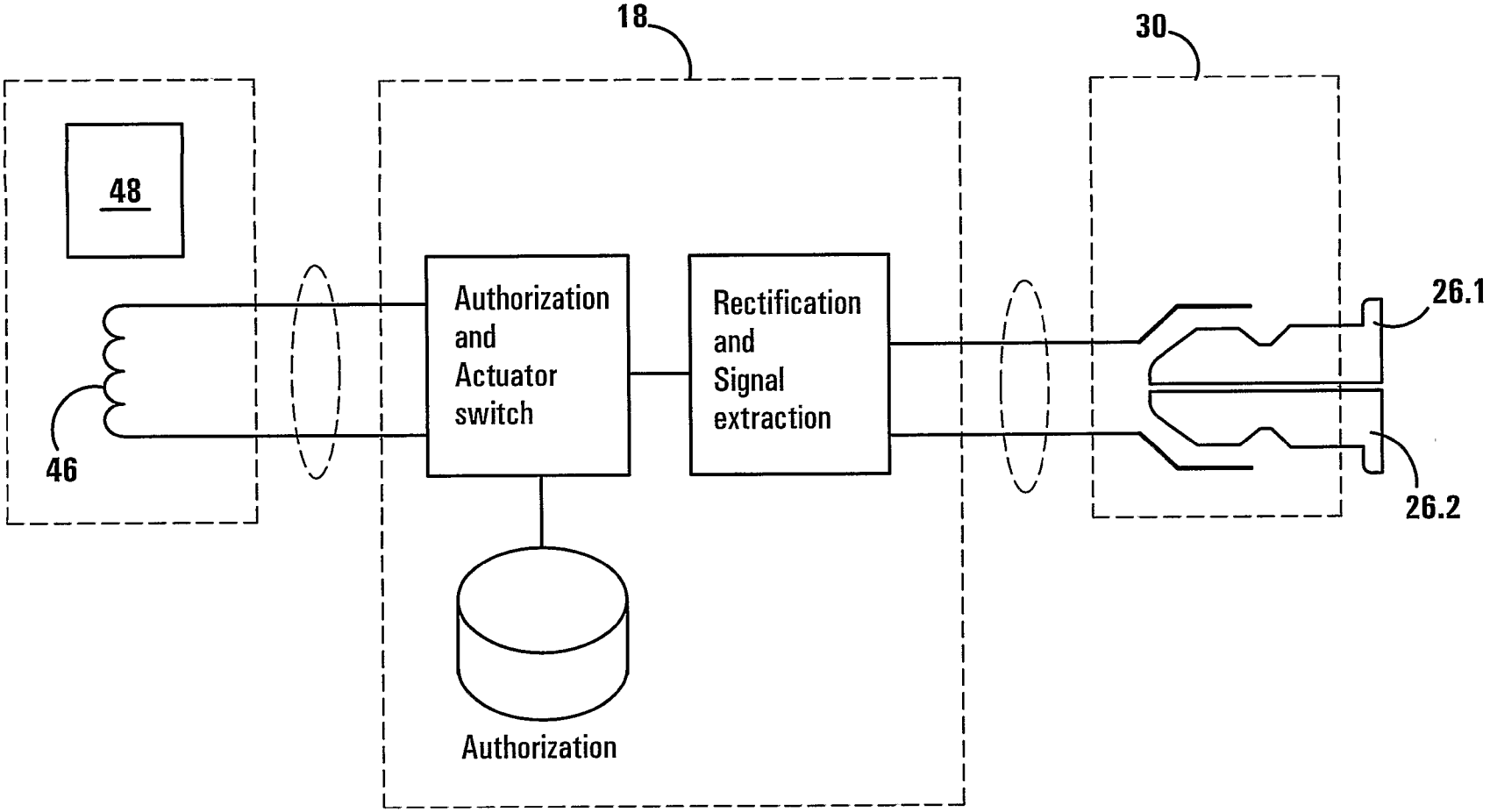
FIG. 19 shows a schematic block diagram illustrating the manner in which the key causes actuation of the lock of FIG. 1.
Figure 20:
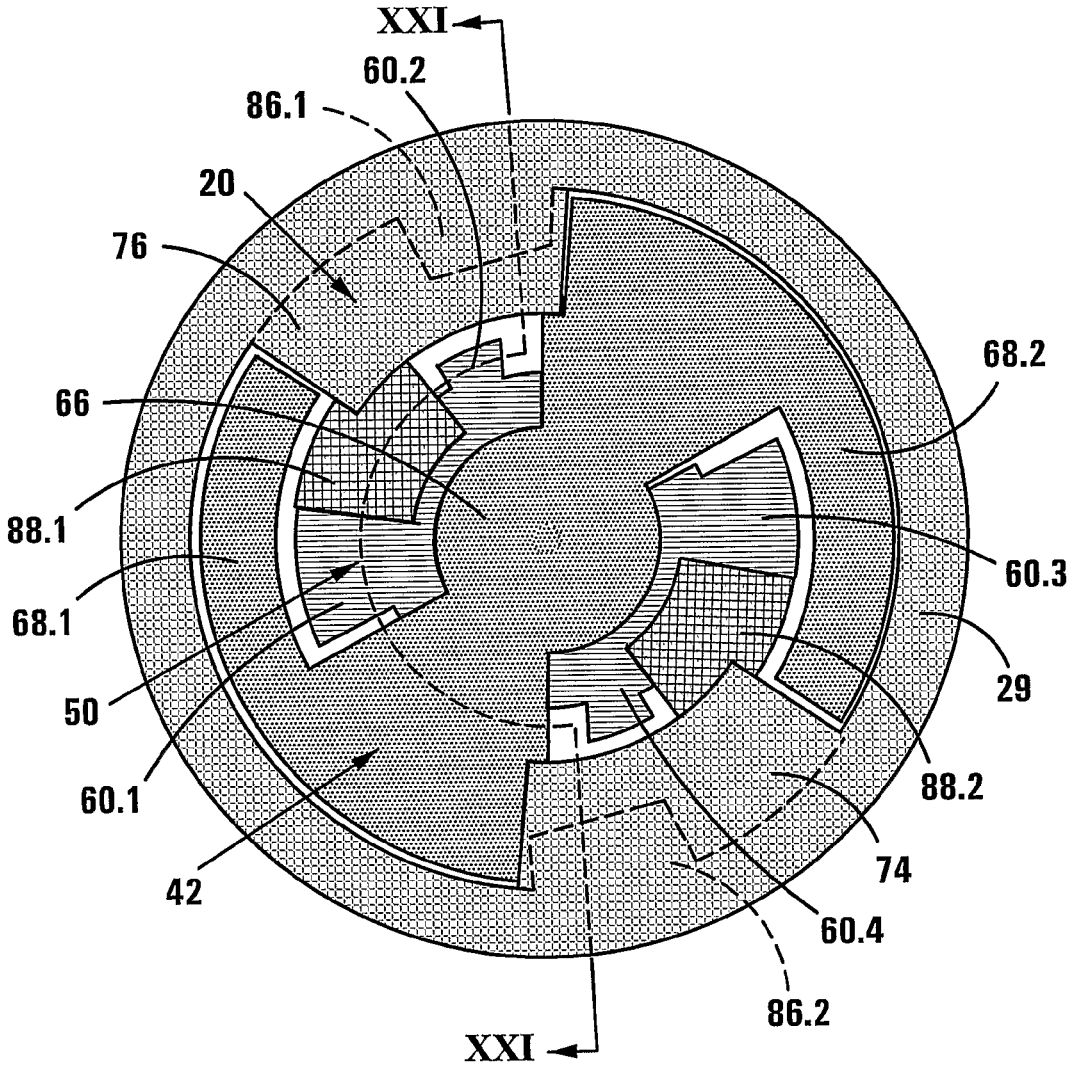
FIG. 20 shows a schematic sectional plan view from the rear end, of the lock of FIG. 1, sectional along section line XX-XX of FIG. 2.
Figure 21:
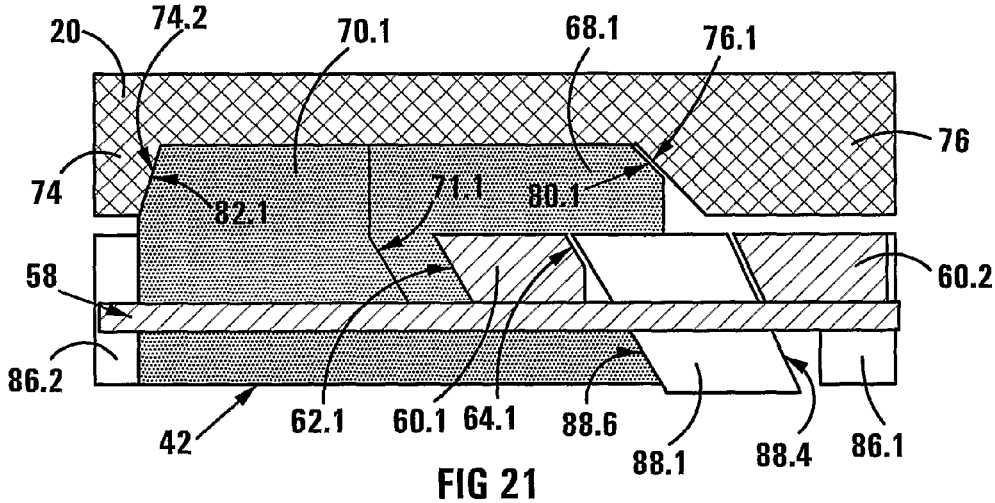
FIG. 21 shows a 180° cylindrical cross-section through the lock along section line XXI-XXI of FIG. 20, illustrating the clutch mechanism as viewed from the centre of the cylinder, with all of the clutch mechanism components projected onto a common radius.

With reference to FIG. 18 of the drawings, the coil 46 is a hollow cylinder with an outer diameter of 4.88 mm, an inner diameter of 3.68 mm and a width of 2.11 mm. The coil 46 is electrically connected to the control unit 18 via electrical conductors 19.1 and 19.2. The magnet 48 is 3×3 mm Neodymium magnet which provides a radial clearance of 0.35 mm between the magnet and the coil, sufficient to permit winding of the coil on the cylindrical wall 56 of the bobbin 50. The cylindrical wall 56 of the bobbin is 0.2 mm thick, which is of adequate thickness to permit fabrication by conventional plastic moulding techniques. As the force drops off as the clearance is increased, the clearances should be kept as small as possible. A radial clearance of 0.14 mm provides sufficient clearance for mounting misalignments or coil distortion.

Figure 25:
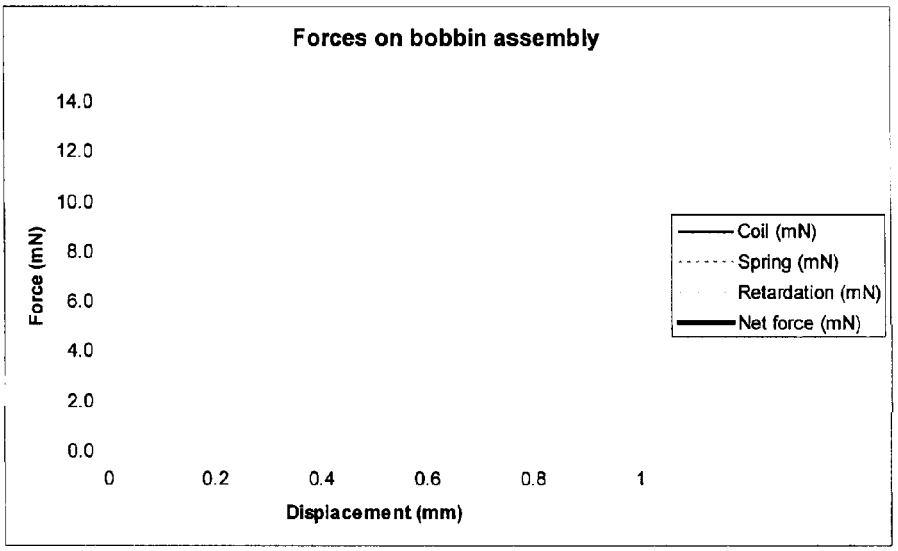
FIG. 25 illustrates a graph which charts the forces on the bobbin assembly.

The coil 46 has a resistance of 300Ω drawing 6.67 mA at 2V. The coil is fixedly coupled to the bobbin 50 which permits it to be slid over the front end of the magnet 48. The force generated by the coil 46 ranges from 10.7 mN to 12.7 mN as the coil is displaced across its operating range of 1.3 mm (see FIG. 25). The force of the bobbin return spring ranges from 5.0 mN to 7.7 mN over the corresponding range. These forces are sufficient to accelerate the bobbin 50 and coil 46 with total mass of about 70 mg at an acceleration of 5-8 g, providing an overall actuation time of 6 ms.

The cup 40 has a baseplate 41 defining two electrical wire channel holes 54 and a cylindrical side wall 58 which extends from baseplate 41. The cup 40 serves three functions: firstly, to conduct the magnetic flux from the far pole of the magnet 48 across the coil 46, which increases the coil force by about 30%; secondly, to prevent excessive magnetic flux from escaping which may interfere with other devices and/or attract metallic particulate matter; and thirdly, to provide protection against external magnetic interference. The bobbin return spring 52 is seated between the baseplate 41 of the cup 40 and the coil 46.

With reference to FIGS. 4-8 of the drawings, the cylinder casing 29 defines an inner cylindrical wall section 84 which has a slightly larger internal diameter than the external diameter of the coupler 42, thereby permitting the coupler 42 to be received within the cylindrical wall section 84. The cylinder casing 29 has a pair of diametrically opposed longitudinally-extending ribs 86.1 and 86.2, which project inwardly from the wall section 84. An annular stop formation 88 extends inwardly from the wall section 84. Curved lips 89.1 and 89.2 extend from the stop formation 88 towards the front end of the lock. The casing includes two diametrically opposed guide arms 88.1 and 88.2 which are spaced from the wall section and which extend longitudinally from the stop formation towards a front end of the lock. Tabs 90 extend inwardly from distal ends of the ribs. The guide arms 88.1 and 88.2 define slanted retreat faces 88.4 and 88.5 respectively; and further define slanted lifting faces 88.6 and 88.7, respectively, the purpose of which will be described hereinafter.

When received within the casing 29, the ribs 86.1 and 86.2 are received within the circumferential spaces 78.1 and 78.2, respectively. As such, when the cylinder casing 29 is caused to rotate in an anti-clockwise direction (viewed from the rear end of the lock), the abutment faces 92.1 and 92.2 are brought into abutment with the ribs 86.2 and 86.1, respectively, thereby permitting a torque which is applied to the cylinder casing 29 to be transmitted to the coupler 42.

The casing 29 defines a number of locating formations 87 at its front end for locating and connecting the key housing 30 thereto.

In the inactivated (home) condition of the clutch mechanism 22, the bobbin 50 is located within the coupler 42 in an arrangement wherein the front end of the boss 66 of the coupler is received within the aperture 57 of the bobbin.

In an uncoupled condition of the lock, the cylinder 16 is not engaged by the clutch mechanism and thus not coupled to the tailpiece 20. As such, when the key housing 30 is rotated by the key, the cylinder 16 rotates in synchrony with the key housing 30 but the tailpiece 20 and thereby the tailpiece adapter 24, is left unmoved.

Figure 23A:
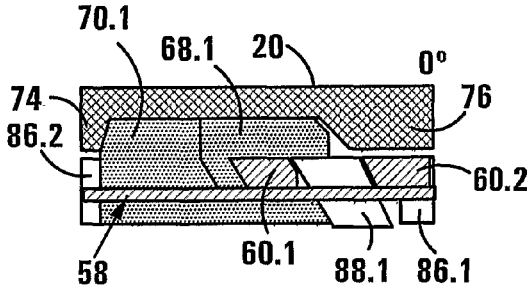
FIGS. 23A to 23D show radial cross-sectional views of the tailpiece, coupler, bobbin and cylinder, illustrating, in sequence, the actuation of the clutch mechanism.
Figure 23B:
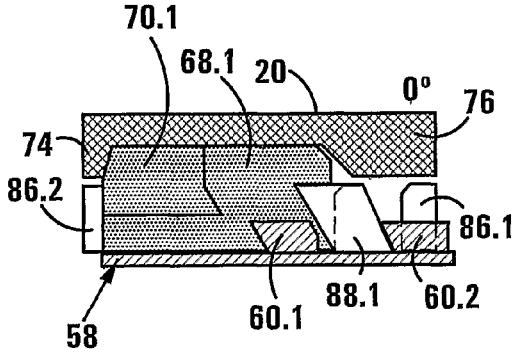
Figure 23C:
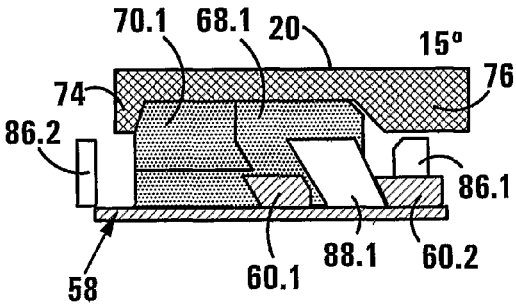
Figure 23D:
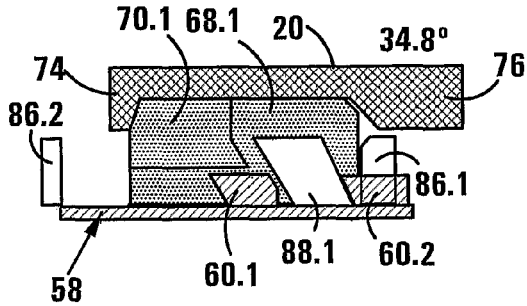

In use, when the key 14 is inserted into the keyway in the key housing 30 and the code communicated to the control unit 18 is authenticated, an energy pulse is sent from the key to the control unit energizing the coil 46 thereby to actuate the clutch mechanism. The bobbin 50, actuated by the coil 46, is impelled into the steel cup 40. With reference to FIGS. 23A-23D, the blocking cogs are lifted above the webs 70.1 and 70.2 of the coupler 42, permitting the coupler 42 to rotate freely with respect to the bobbin 50. FIG. 23A shows the clutch mechanism 22 in its home position prior to the coil being energized. FIG. 23B shows the retraction of the bobbin upon activation of the coil 46. As the cylinder 16 is rotated with respect to the tailpiece 20, the ribs 86.1 and 86.2 of the cylinder abut against the abutment faces 92.1 and 92.2, respectively, transmitting the torque from the cylinder to the coupler 42. The engagement faces 82.1 and 82.2 of the coupler 42, in turn abuts the engagement faces 76.2 and 74.2 respectively, of the tailpiece 20, thereby causing the cylinder and the tailpiece to become rotatably coupled and the torque to be transmitted from the cylinder to the tailpiece. FIG. 23C shows the lock rotated through 15°, whereas FIG. 23D shows the lock in an engaged position rotated through 34.8°.

Figure 22A:
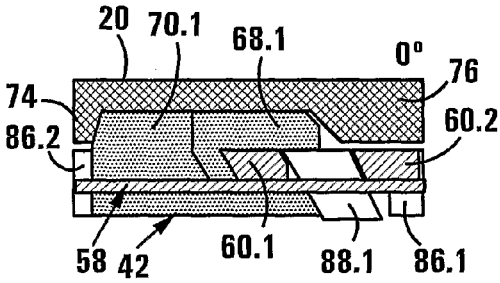
FIGS. 22A to 22E show radial cross-sectional views of the tailpiece, coupler, bobbin and cylinder illustrating, in sequence, the disengagement of the clutch mechanism.
Figure 22B:
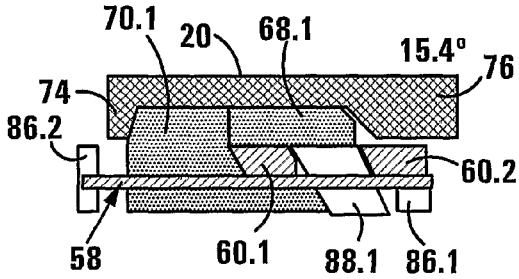
Figure 22C:
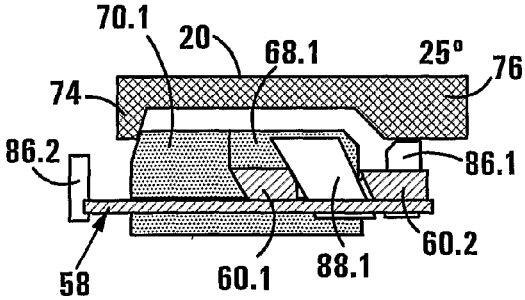
Figure 22D:
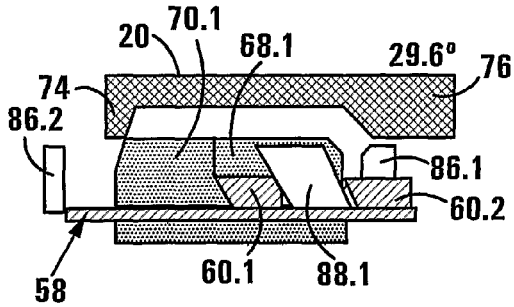

With reference to FIGS. 22A-22E, when the coil is not actuated and the cylinder is rotated with respect to the tailpiece, the engagement faces 62.1 and 62.2 of the bobbin blocking cogs 60.1 and 60.3 engage the abutment faces 71.1 and 71.2, respectively, of the coupler 42, causing the bobbin 50 and coupler 42 to become locked together as a single unit (see FIG. 22B). In a coupled condition of the lock, the bobbin and coupler are coupled and further turning of the cylinder 16 results in pressure being applied via the lifting faces 88.6 and 88.7 on the guide arms 88.1 and 88.2, respectively, and the lifting faces 64.1 and 64.2 on the bobbin blocking cogs 60.1 and 60.3, respectively; and pressure is further applied between the engagement faces 82.1 and 82.2 of the coupler 42 and the engagement faces 74.2 and 76.2 of the tailpiece. The combined slopes of both the lifting and engaging faces are configured so as to overcome any friction existing between the surfaces with a minimum required angular rotation, causing the rotatably coupled bobbin and coupler assembly to be ejected along the cylinder casing towards the front end thereof (see FIG. 22C).

Figure 22E:
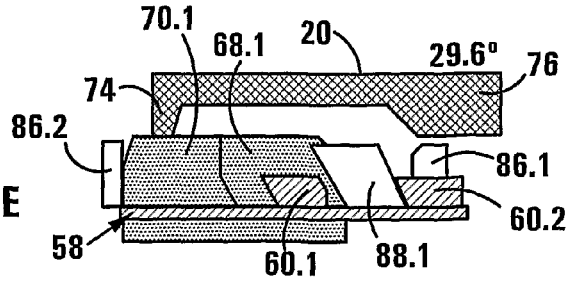

The coupler is lifted off the tailpiece 20 (see FIG. 22D), and the clutch mechanism is thus disengaged and the cylinder is free to rotate with respect to the tailpiece (see FIG. 22E).

An essential requirement for the clutch is that it must not be possible to engage it by means of external acceleration or shock, and this is accomplished in the following manner. The mass of coupler 42 is balanced by a torsion spring 96 which extends between curved step formations 98.1 and 98.2 extending inwardly from the wall sections 68.1 and 68.2 of the coupler, and the step formation 88 of the cylinder casing. As such, when the clutch mechanism is accelerated from the front end of the lock towards the tailpiece 20 at an acceleration exceeding 3 g, the coupler 42 sinks into the cylinder casing. The bobbin 50 and coil 46 are relatively light and as such, will only sink into the cup 40 against the force of the spring 52 at a relatively higher acceleration. For all accelerations, the bobbin 50 thus rests on the coupler in its blocking position, and any attempt to turn the cylinder will result in the clutch mechanism being disengaged.

Figure 2:
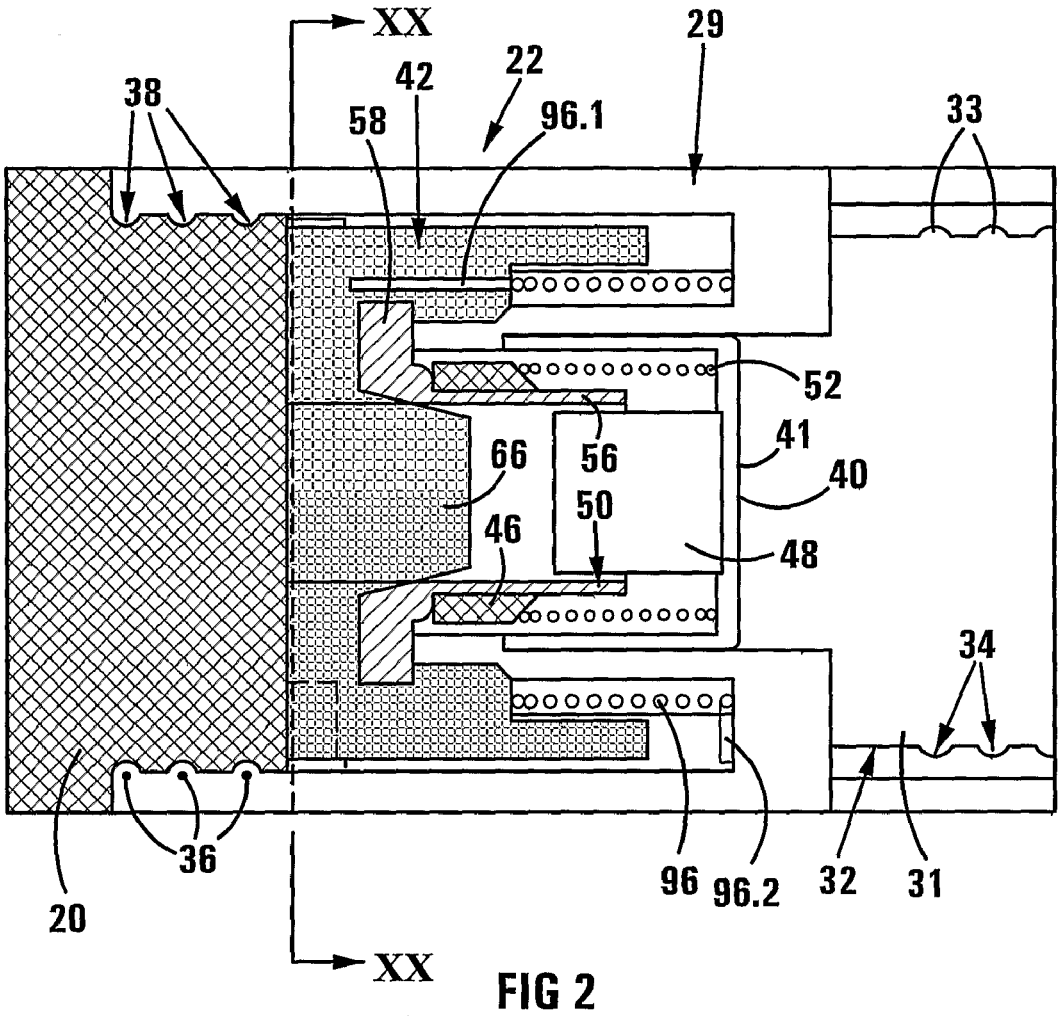
FIG. 2 shows a schematic enlarged fragmentary sectional side view of the lock of FIG. 1.
Figure 3:
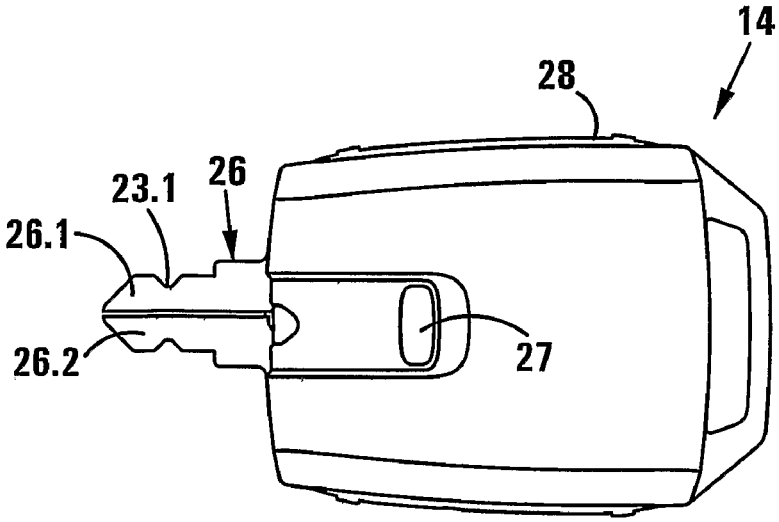
FIG. 3 shows a schematic side view of a key of the lock in accordance with the invention.
Figure 4:
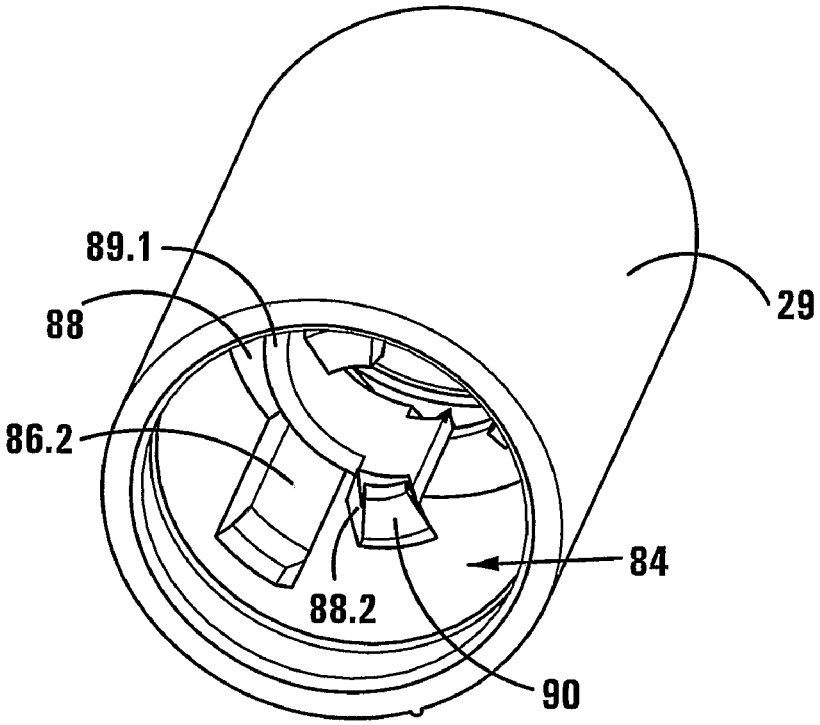
FIG. 4 shows a perspective view of the cylinder casing of the lock of FIG. 1.
Figure 5:
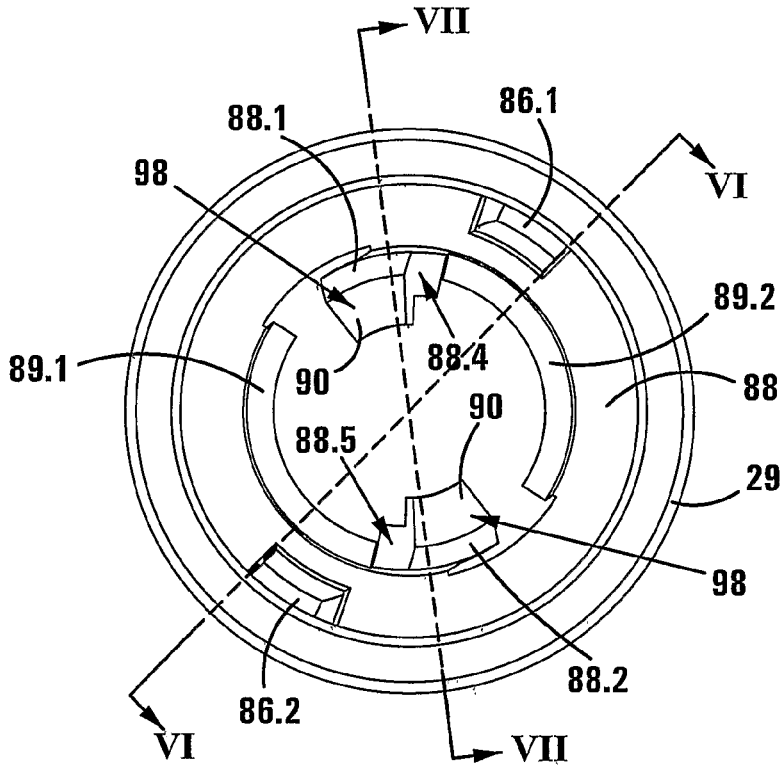
FIG. 5 shows a schematic rear end plan view of the cylinder casing of the lock of FIG. 1.
Figure 6:
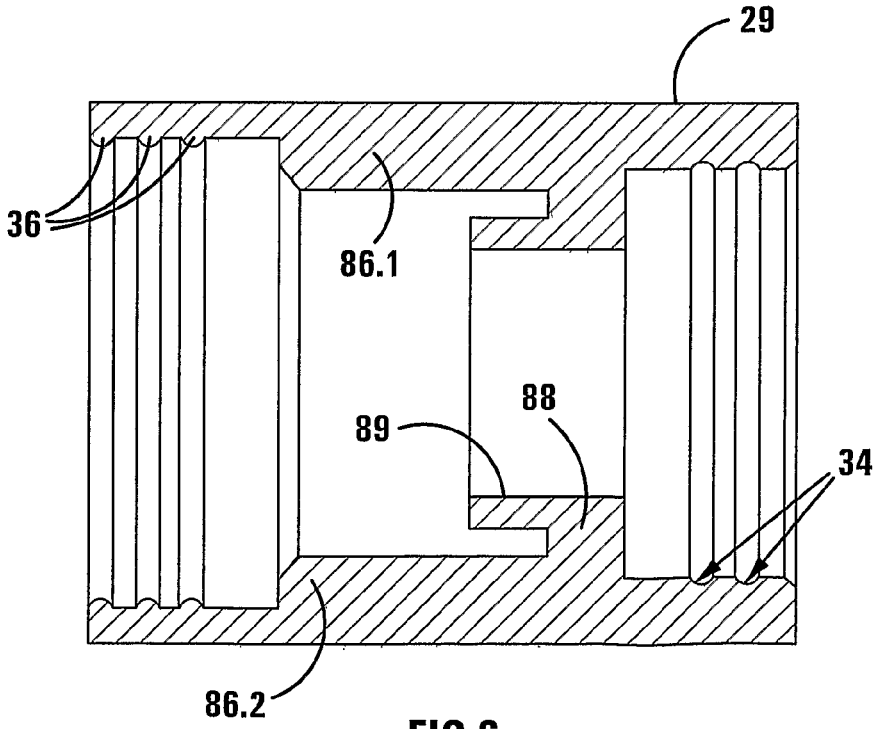
FIG. 6 shows a schematic sectional side view of the cylinder casing of FIG. 4, sectional along section line VI-VI of FIG. 5.
Figure 7:
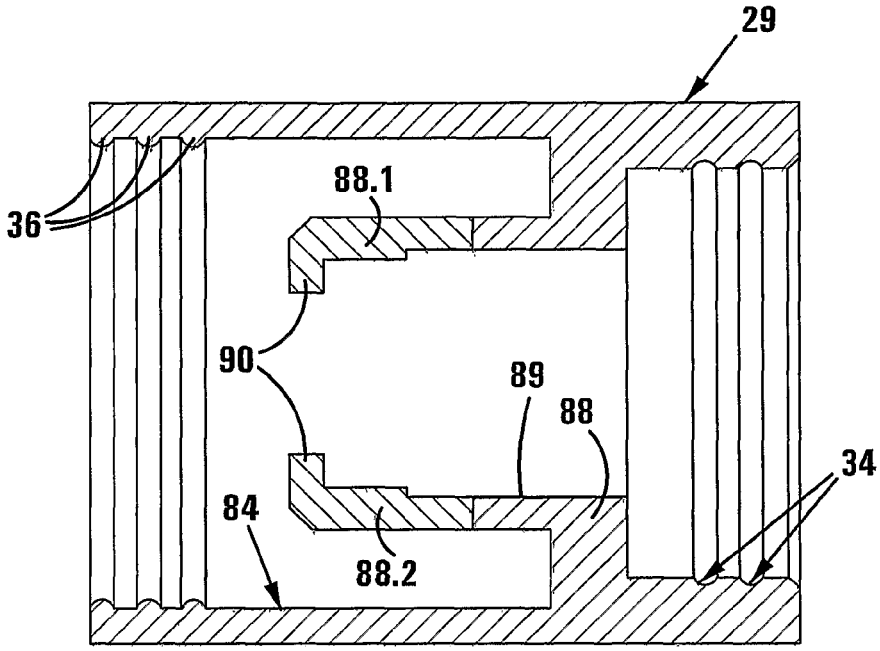
FIG. 7 shows a schematic sectional side view of the cylinder casing of FIG. 4, sectioned along section line VII-VII of FIG. 5.
Figure 8:
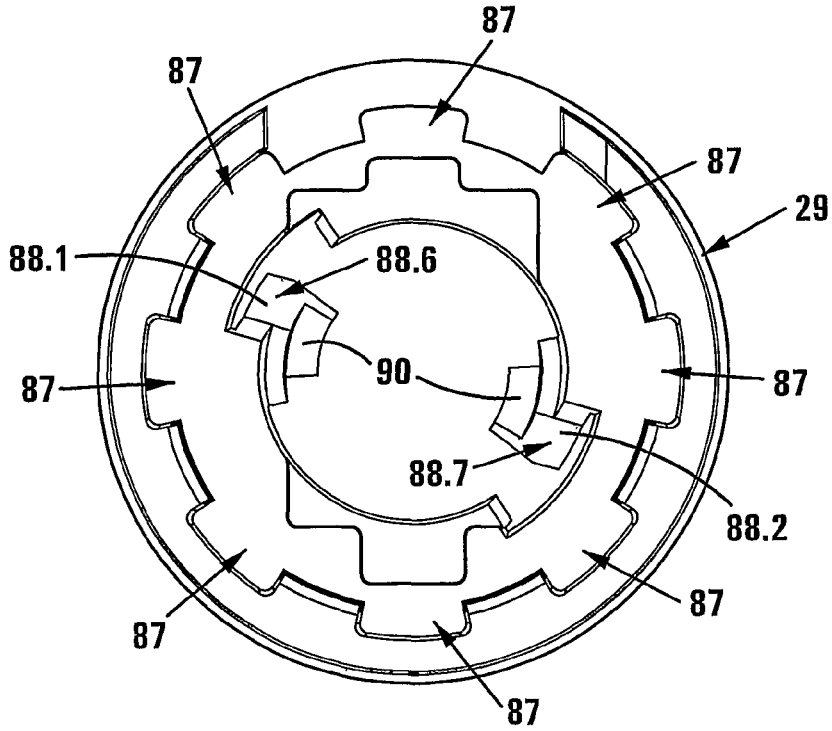
FIG. 8 shows a schematic front end plan view of the cylinder casing of FIG. 4.
Figure 24A:
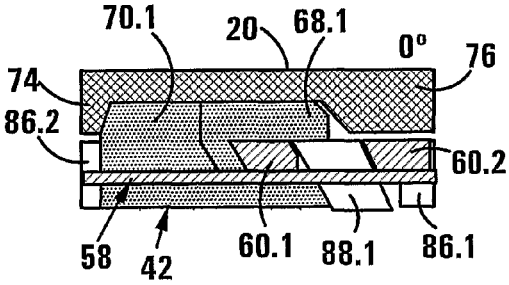
FIGS. 24A to 24D show radial cross-sectional views of the tailpiece, coupler, bobbin and cylinder, illustrating, in sequence, the manner in which the clutch mechanism is disengaged when a shock is applied to the lock.
Figure 24B:
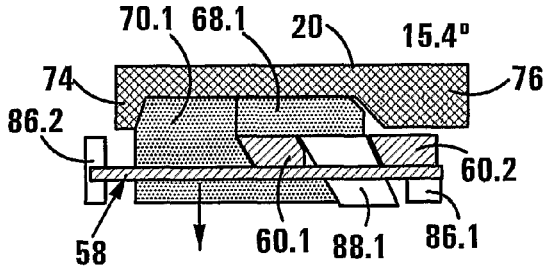
Figure 24C:
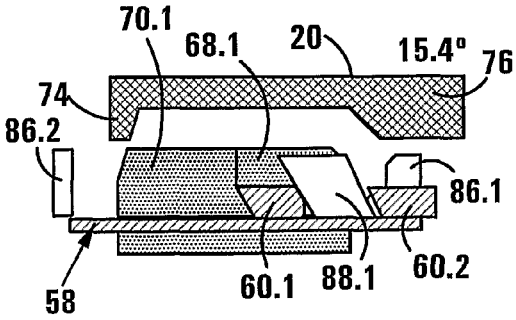
Figure 24D:
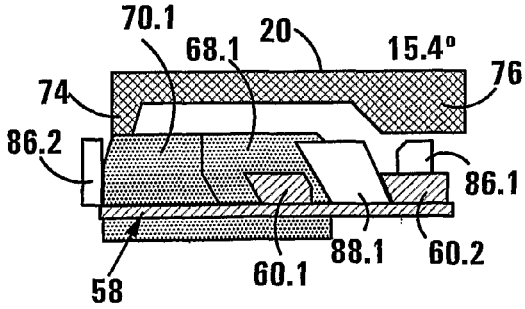

When subjected to rapid shock or violent vibration, however, the motion of the bobbin with respect to the coupler is mostly random. In this event, the coupler bounces up and down along the cylinder casing. With reference to FIG. 2 and FIG. 14, the torsion spring 96 maintains a constant torque on the coupler. An axial leg 96.1 at the end of torsion spring 96 penetrates one of the well formations 69.1 or 69.2. A perpendicular leg 96.2 braces against one of the ribs 86.1 or 86.2 in the cylinder casing. In this manner, the torsion spring 96 retains the coupler against the ribs 86.1 and 86.2 of the cylinder casing. With reference to FIGS. 24A-24 D, if the cylinder is rotated with respect to the tailpiece 20, when subjected to shock, the coupler is lifted off the protuberances 74 and 76 of the tailpiece 20. The torsion spring 96 rotates the coupler over the protuberances 74 and 76 towards the ribs 86.1 and 86.2 of the cylinder casing, causing the clutch to become disengaged.

In addition to longitudinal shock the cylinder could be subjected to angular shock, in which event the force of the torsion spring could be overcome, causing the cog to become re-engaged. However, there is no theoretical limit to the strength of the torsion spring that can be employed, and the slopes of the engaging faces 74.2 and 76.2 can be correspondingly adjusted to compensate for the friction on the slopes to ensure that the shock response of the coupler remains unaffected when torqued by the torsion spring. Even with a relatively weak torsion spring, it proves in practice to be exceedingly difficult if not impossible to engage the clutch mechanism by means of external shock alone.

A design target is to minimize the turn angle required from the home position to the point at which the clutch mechanism engages; usually a lock set requires this turn to be less than 35°. This is accomplished, firstly, by making the angular width of the bobbin blocking cogs 60.1 and 60.3 as small as is compatible with mechanical requirements; and, secondly, by employing slanted retreating faces 88.4 and 88.5 of the guide arms 88.1 and 88.2 of the cylinder casing 29. The retreating faces are angled such that when the bobbin 50 is lifted up the guide column, the bobbin faces 60.5 and 60.6 on the bobbin guide cogs 60.2 and 60.4 interact with the retreating faces 88.4 and 88.5 to cause the bobbin to rotate in a clockwise direction as seen from the rear end of the lock. This rotation brings about an additional clearance between the engaging faces 62.1 and 62.2 on the bobbin and the engaging faces 71.1 and 71.2 on the cog, permitting the engaging faces to be partially engaged prior to actuation of the coil and consequently requiring a smaller turn before the clutch mechanism is engaged.

The clutch mechanism 22 may include a clutch actuation position indicator mechanism which is operable to notify the microcontroller of the control unit 18 when the clutch mechanism is in a position to be actuated. The clutch actuation position indicator mechanism is facilitated by a formation within the cylinder which generates a small clicking sound that is detectable as a voltage spike in the coil 46. The microcontroller is operable to generate an actuation signal in response to the voltage spike being detected by the microcontroller.

The benefit of such a mechanism is that the power need only be applied to the actuator when the user starts to turn the cylinder, thereby prolonging the key's battery life. In practice however the key's power consumption is dominated by the standby current required by the key's electronics, and such mechanisms are therefore optional in a real-world application.

It will be appreciated that the exact configuration of the lock and of the key may vary greatly while still incorporating the general principles of the invention described hereinabove. In particular, the applicant envisages that engagement of the cylinder and tailpiece can be achieved by means other than cogs, such as ball bearings, pins, ratchets, toothed wheels or friction-engaging members all of which are comprehended by the above invention. The exact configuration of the clutch mechanism may also vary while still incorporating the essential features defined herein.

The application of the clutch mechanism may be extended to any application for which a clutch is required and for which speed, low power consumption, low cost and shock resistance are important requirements. Possible application areas include robotics, valves, and power distribution in toys or other mechanical devices.

The invention claimed is:

1. A lock comprising:

a) a cylinder defining an axis of rotation and having a front end and an opposite rear end, which can be rotatably mounted to a first component to be locked, the cylinder including at least one second locking formation; a keyway at the front end thereof, for a key having an electrical power source and electrical connection means which provides an electrical connection with the electrical power source of the key;

b) a tailpiece which defines an axis of rotation common with the axis of rotation of the cylinder, the tailpiece including at least one first locking formation and being operable to interfere with the movement of a second component to be locked, the tailpiece being mounted to the cylinder at the rear end thereof in an arrangement wherein relative rotation between the tailpiece and the cylinder is permitted in an uncoupled condition of the lock and wherein the cylinder and the tailpiece are rotatably coupled in a coupled condition of the lock;

c) an electrically-operated clutch mechanism which includes at least one locking mechanism which is operable, upon actuation of the clutch mechanism, to releasably engage the first and second locking formations thereby causing the cylinder and the tailpiece to become rotatably coupled in the coupled condition of the lock; and d) electronic control means which is electrically connected to the electrical connection means and to the clutch mechanism and which is operable to generate an actuation signal for actuating the clutch mechanism, the lock being characterized in that the locking mechanism of the clutch mechanism includes a magnet, an electrical coil displaceably located within, the magnetic field of the magnet, a locking member having engagement formations for engaging the first and second locking formations, a blocking member to which the coil is fixedly connected, and first urging means for urging the blocking member into a blocking position relative to the locking member, the blocking member being operable in the blocking position, to cause disengagement of the locking member with the first and second locking formations in the uncoupled condition of the lock when the cylinder is rotated with respect to the tailpiece, the coil being electrically connected to the electronic control means in an arrangement wherein the coil is energized by power supplied by the power source of the key, in response to an actuation signal being received from the electronic control means, thereby to cause displacement of the blocking member out of the blocking position against the force exerted on it by the urging means, thereby allowing the locking member to engage the first and second locking formations in the coupled condition of the lock.

2. The lock as claimed in claim 1, wherein the locking mechanism of the clutch mechanism comprises a second urging means for urging the locking member into engagement with the first and second locking formations.

3. The lock as claimed in claim 1, wherein the clutch mechanism is housed within the cylinder.

4. The lock as claimed in claim 1, wherein the electronic control means is housed within the cylinder.

5. The lock as claimed in claim 1, wherein the locking member and the blocking member define common axes of rotation which are common to the axes of rotation of the cylinder and the tailpiece.

6. The lock as claimed in claim 1, wherein the first urging means is in the form of a compression spring.

7. The lock as claimed in claim 5, wherein the locking member is located rearwardly of the blocking member, the locking member being of relatively higher mass than that of the blocking member and the second urging means applying a sufficiently low urging force to the locking member so that if an external shock is applied to the lock in a longitudinal direction from the front end of the cylinder towards the tailpiece sufficient to cause the locking member to be displaced rearwardly into disengagement with the first and second locking formations, the blocking member will only be displaced from its blocking position at a relatively higher acceleration, thereby preventing coupling of the cylinder and the tailpiece.

8. An electromechanical locking system comprising:

a key having an electrical power source; and a lock comprising:

a) a cylinder defining an axis of rotation and having a front end and an opposite rear end, which can be rotatably mounted to a first component to be locked, the cylinder including at least one second locking formation; a keyway at the front end thereof, for the key and an electrical connection means which provides an electrical connection with the electrical power source of the key;

b) a tailpiece which defines an axis of rotation common with the axis of rotation of the cylinder, the tailpiece including at least one first locking formation and being operable to interfere with the movement of a second component to be locked, the tailpiece being mounted to the cylinder at the rear end thereof in an arrangement wherein relative rotation between the tailpiece and the cylinder is permitted in an uncoupled condition of the lock and wherein the cylinder and the tailpiece are rotatably coupled in a coupled condition of the lock;

c) an electrically-operated clutch mechanism which includes at least one locking mechanism which is operable, upon actuation of the clutch mechanism, to releasably engage the first and second locking formations thereby causing the cylinder and the tailpiece to become rotatably coupled in the coupled condition of the lock; and d) electronic control means which is electrically connected to the electrical connection means and to the clutch mechanism and which is operable to generate an actuation signal for actuating the clutch mechanism, the lock being characterized in that the locking mechanism of the clutch mechanism includes a magnet, an electrical coil displaceably located within the magnetic field of the magnet, a locking member having engagement formations for engaging the first and second locking formations, a blocking member to which the coil is fixedly connected, and first urging means for urging the blocking member into a blocking position relative to the locking member, the blocking member being operable in the blocking position, to cause disengagement of the locking member with the first and second locking formations in the uncoupled condition of the lock when the cylinder is rotated with respect to the tailpiece, the coil being electrically connected to the electronic control means in an arrangement wherein the coil is energized by power supplied by the power source of the key, in response to an actuation signal being received from the electronic control means, thereby to cause displacement of the blocking member out of the blocking position against the force exerted on it by the urging means, thereby allowing the locking member to engage the first and second locking formations in the coupled condition of the lock.

9. The electromechanical locking system as claimed in claim 8, wherein the locking mechanism of the clutch mechanism comprises a second urging means for urging the locking member into engagement with the first and second locking formations.

10. The electromechanical locking system as claimed in claim 8, wherein the clutch mechanism is housed within the cylinder.

11. The electromechanical locking system as claimed in claim 8, wherein the electronic control means is housed within the cylinder.

12. The electromechanical locking system as claimed in claim 8, wherein the locking member and the blocking member define common axes of rotation which are common to the axes of rotation of the cylinder and the tailpiece.

13. The electromechanical locking system as claimed in claim 8, wherein the first urging means is in the form of a compression spring.

14. The electromechanical locking system as claimed in claim 9, wherein the locking member is located rearwardly of the blocking member, the locking member being of relatively higher mass than that of the blocking member and the second urging means applying a sufficiently low urging force to the locking member so that if an external shock is applied to the lock in a longitudinal direction from the front end of the cylinder towards the tailpiece sufficient to cause the locking member to be displaced rearwardly into disengagement with the first and second locking formations, the blocking member will only be displaced from its blocking position at a relatively higher acceleration, thereby preventing coupling of the cylinder and the tailpiece.

* * * * *